US009673505B2

(12) United States Patent
Wu et al.

(10) Patent No.: US 9,673,505 B2
(45) Date of Patent: Jun. 6, 2017

(54) ANTENNA ROTATION MECHANISM

(71) Applicant: Wistron NeWeb Corporation, Hsinchu (TW)

(72) Inventors: Shang-Cheng Wu, Hsinchu (TW); Yu-Jui Chiang, Hsinchu (TW); Jin-Jong Lin, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 660 days.

(21) Appl. No.: 14/076,279

(22) Filed: Nov. 11, 2013

(65) Prior Publication Data

US 2014/0299733 A1 Oct. 9, 2014

(30) Foreign Application Priority Data

Apr. 9, 2013 (TW) ..... 102112544 A

(51) Int. Cl.
*H01Q 1/12* (2006.01)
*H01Q 3/04* (2006.01)
*H01Q 1/20* (2006.01)

(52) U.S. Cl.
CPC ..... *H01Q 1/125* (2013.01); *H01Q 1/12* (2013.01); *H01Q 1/20* (2013.01); *H01Q 3/04* (2013.01)

(58) Field of Classification Search
CPC H01Q 1/12; H01Q 3/04; H01Q 1/125; H01Q 1/20; H01Q 1/14; H01Q 1/246; H01Q 1/085; H01Q 3/00; H01Q 3/005
USPC ..... 248/542, 571, 603, 604, 611, 621, 678, 248/346.01–346.06, 274.1, 65, 289.11, 248/70; 384/402, 590, 142, 191, 193, 49, 384/50, 161, 440; 343/757, 869, 878, 343/884
See application file for complete search history.

(56) References Cited

U.S. PATENT DOCUMENTS 2,343,684 A * 3/1944 Mace ..... H01Q 1/103 174/138 A
2,623,175 A * 12/1952 Finke ..... H01Q 1/103 242/137.1
2,900,154 A * 8/1959 Schweim ..... H01Q 3/005 248/148
2,912,693 A * 11/1959 Avery ..... G01S 1/02 343/757
2,928,087 A * 3/1960 Parker ..... G01S 1/02 342/399

(Continued)

*Primary Examiner* — Muhammad Ijaz
(74) *Attorney, Agent, or Firm* — Winston Hsu; Scott Margo

(57) ABSTRACT

An antenna rotation mechanism includes a bearing holder, a bearing, a first pressing member, a second pressing member, a plurality of first elastic arms and a plurality of second elastic arms. The bearing is disposed on an elastic fixing socket of the bearing holder. The first pressing member is disposed on first plane of the bearing and the second pressing member is disposed on second plane of the bearing. When the first pressing member abuts against the each first elastic arm along a first axial direction, the each first elastic arm provides a first radial thrust to the bearing, to force the bearing to move to an axle center. When the second pressing member abuts against the each second elastic arm along a second axial direction, the second first elastic arm provides a second radial thrust towards the bearing to force the bearing to move to the axle center.

7 Claims, 13 Drawing Sheets

(56) References Cited

U.S. PATENT DOCUMENTS 2,966,811 A * 1/1961 Sundt ..... F16H 1/32 343/766
3,812,307 A * 5/1974 Wagner ..... H02G 11/02 191/12.4
4,136,986 A * 1/1979 Grashow ..... H01Q 1/1214 174/153 A
4,384,688 A * 5/1983 Smith ..... B65H 75/4434 191/12.2 R
4,431,332 A * 2/1984 Dieges ..... F16B 43/02 174/153 A
4,592,595 A * 6/1986 Freeman ..... B60B 33/0028 152/379.3
4,665,406 A * 5/1987 Takizawa ..... H01Q 1/103 343/714
5,018,407 A * 5/1991 Hoecht ..... F16H 57/0421 184/109
5,090,823 A * 2/1992 Lindsey ..... F16M 11/08 384/493
6,616,080 B1 * 9/2003 Edwards ..... A45C 7/0045 191/12.2 R
6,762,727 B2 * 7/2004 Rochford ..... H01Q 1/1214 24/289
7,898,491 B1 * 3/2011 Curran ..... H01Q 19/134 343/781 CA
8,387,763 B2 * 3/2013 Burke ..... B65H 75/4449 191/12 R
8,836,597 B1 * 9/2014 Vizzio ..... H01Q 3/04 343/757
9,287,694 B2 * 3/2016 Hermey ..... H02G 11/00
2005/0098700 A1 * 5/2005 Tien ..... F16M 11/00 248/346.01
2009/0102314 A1 * 4/2009 Miyata ..... H02K 1/243 310/257
2009/0108119 A1 * 4/2009 Sturgis ..... G02B 6/3604 242/520
2010/0149059 A1 * 6/2010 Patel ..... H01Q 1/005 343/765
2012/0243814 A1 * 9/2012 Sakairi ..... B60G 15/068 384/297
2014/0009328 A1 * 1/2014 Knight ..... G01S 7/03 342/26 R
2014/0308063 A1 * 10/2014 Gold ..... G01S 7/4004 403/83

* cited by examiner

ANTENNA ROTATION MECHANISM

CROSS REFERENCE TO RELATED APPLICATION

This application claims priority benefits to Taiwanese Patent Application No. 102112544, filed on Apr. 09, 2013, which is hereby incorporated by reference in its entirety.

BACKGROUND OF THE INVENTION

1. Field of the Invention

The present invention relates to an antenna rotation mechanism, and more particularly, to an antenna rotation mechanism with automatic self-aligning bearing.

2. Description of the Prior Art

An antenna is one of the most essential components of wireless communication devices. Different wireless communication devices may use different antennas, each having specific types and characteristics. For example, a rotating antenna can be arranged to an appropriate position and direction to receive and transmit signals for excellent transmission performance.

Moreover, for a rotating antenna, a bearing driven by a motor is usually used to enable rotational motion. Since the bearing is a critical component for rotation, the bearing alignment is important to all rotating product. Conventional bearing alignment method is to utilize a further machining process to reduce dimensional variation in assembly for a concentricity requirement. However, a complex precision machining process may result in higher cost of production and longer manufacturing time. Therefore, designing an antenna for low cost and rapid assembly should be a concern in progressive mechanism design.

SUMMARY OF THE INVENTION

It is therefore an objective of the present invention to provide an antenna rotation mechanism for solving above drawbacks.

An embodiment of the invention discloses an antenna rotation mechanism, comprising: a bearing holder; a bearing, disposed on an elastic fixing socket of the bearing holder; a first pressing member, disposed on a first plane of the bearing; a second pressing member, disposed on a second plane of the bearing; a plurality of first elastic arms, connected to the first pressing member, each of the first elastic arms being connected to the first pressing member, wherein when the plurality of first elastic arms abut against an outer surface of the elastic fixing socket along a first axial direction, the each of the first elastic arms provides a first radial thrust force to the bearing, such that the bearing moves towards an axle center; and a plurality of second elastic arms, connected to the second pressing member, each of the second elastic arms being connected to the second pressing member, wherein when the second pressing member abuts against the each of the second elastic arms along a second axial direction, the each of the second elastic arms provides a second radial thrust force to the bearing, such that the bearing moves towards the axle center.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
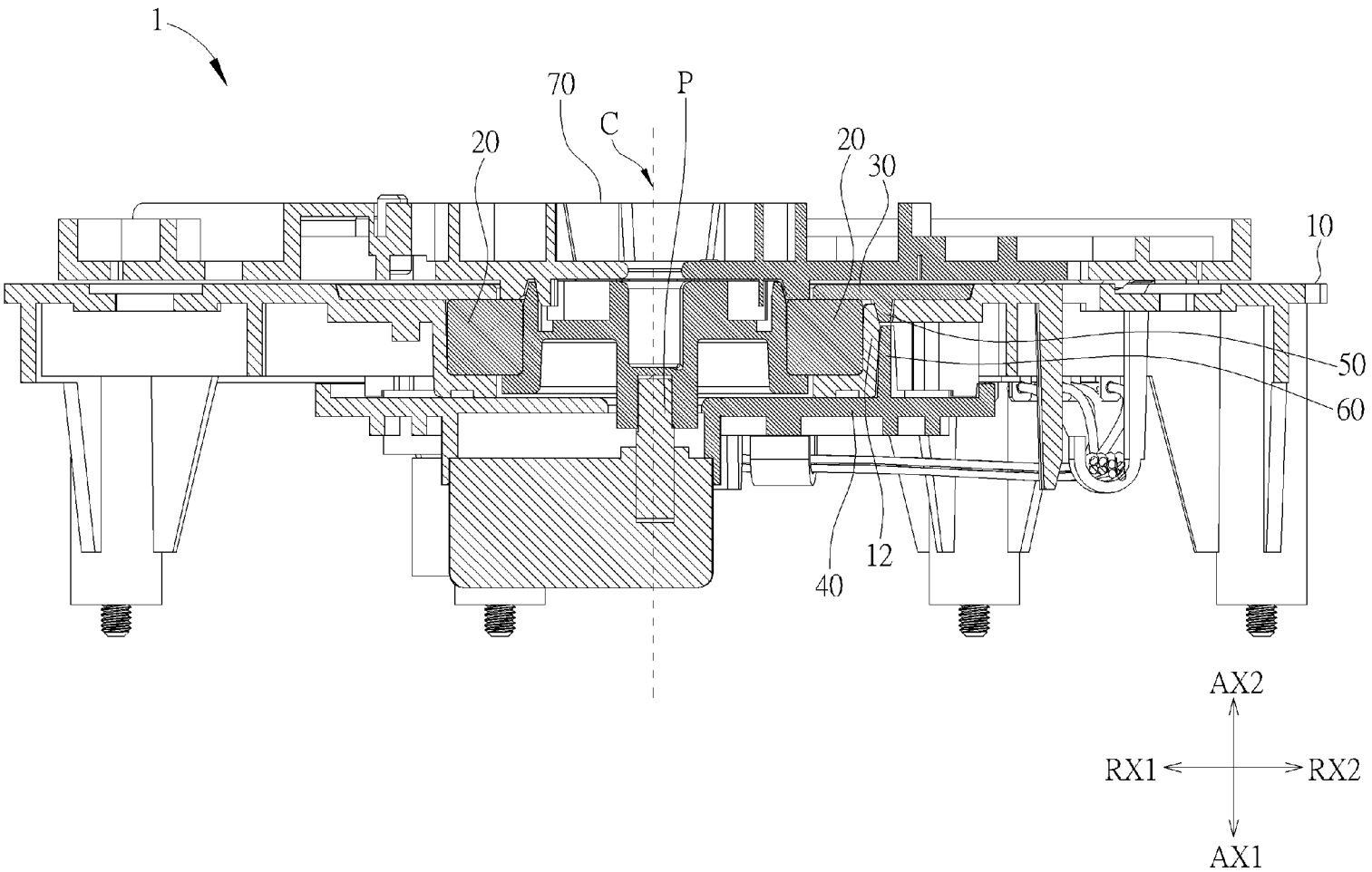
FIG. 1 is a sectional view of an antenna rotation mechanism according to an embodiment of the present invention.
Figure 2:
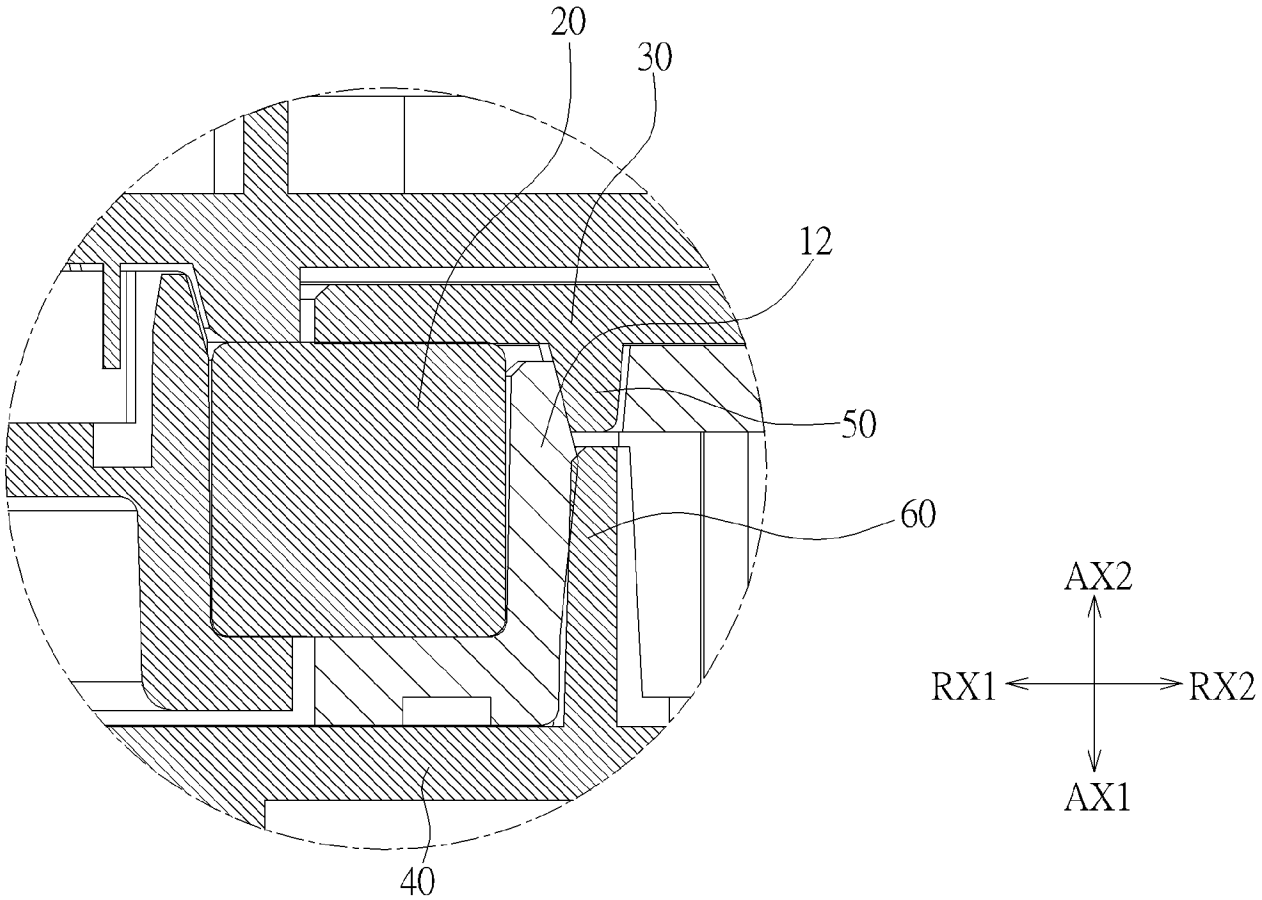
FIG. 2 is a schematic diagram illustrating a portion of the antenna rotation mechanism shown in FIG. 1.
Figure 3:
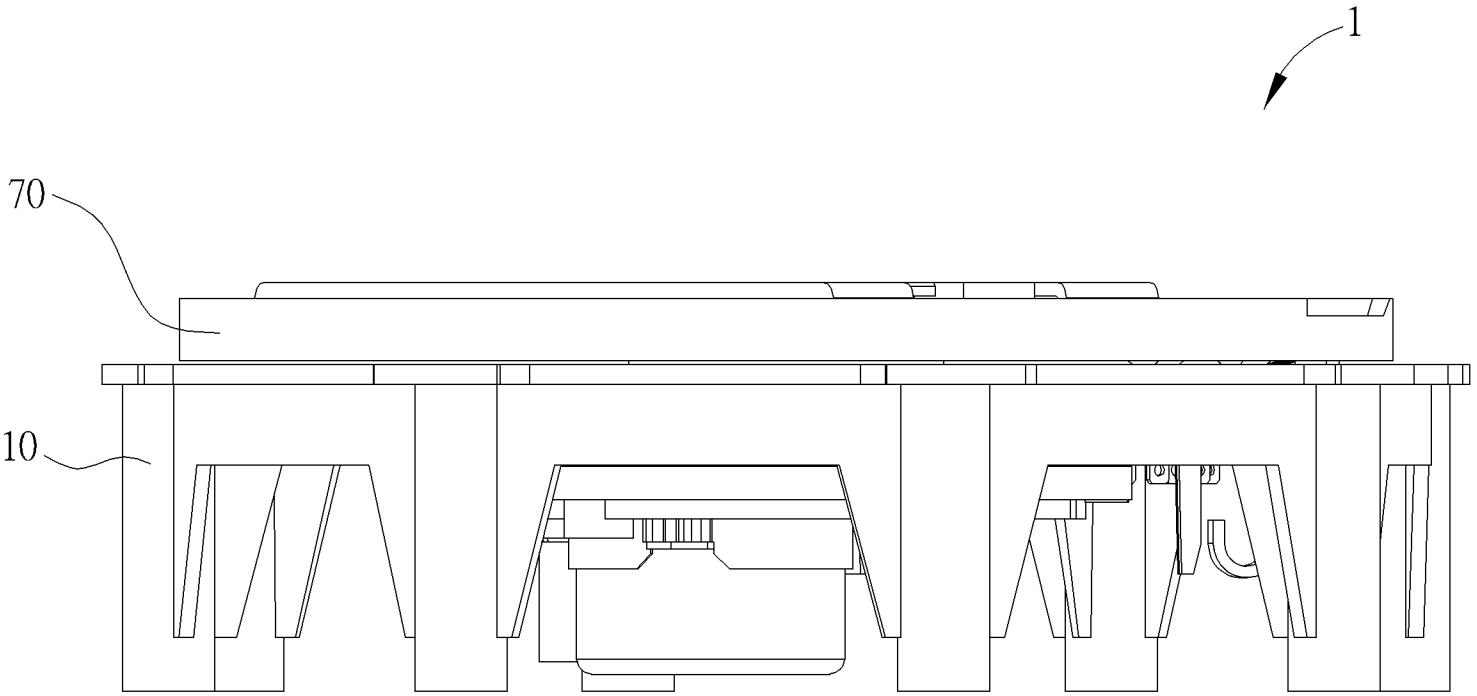
FIG. 3 is an assembly diagram of the antenna rotation mechanism shown in FIG. 1.

Please refer to FIG. 1 to FIG. 3. FIG. 1 is a sectional view of an antenna rotation mechanism 1 according to an embodiment of the present invention. FIG. 2 is a schematic diagram illustrating a portion of the antenna rotation mechanism 1 shown in FIG. 1. FIG. 3 is an assembly diagram of the antenna rotation mechanism 1 shown in FIG. 1. The antenna rotation mechanism 1 includes a bearing holder 10, a bearing 20, a first pressing member 30, a second pressing member 40, first elastic arms 50, second elastic arms 60 and a rotation bracket 70. The rotation bracket 70 is disposed on the bearing 20 via a rotatable shaft P for holding an antenna. The bearing holder 10 includes an elastic fixing socket 12. The bearing 20 is disposed on the elastic fixing socket 12 of the bearing holder 10. The first pressing member 30 is disposed on the top plane of the bearing 20. The second pressing member 40 is disposed on the bottom plane of the bearing 20. The first pressing member 30 can apply a first axial thrust force to the bearing 20 along an axial direction AX1 and the second pressing member 40 can apply a second axial thrust force to the bearing 20 along an axial direction AX2 in the assembly of the antenna rotation mechanism 1. Therefore, the bearing 20 can be axially restrained on the bearing holder 10 via the collaborative operation of the first pressing member 30 and the second pressing member 40. As shown in FIG. 1, the first elastic arm 50 is connected to the first pressing member 30. The second elastic arm 60 is connected to the second pressing member 40. When the first pressing member 30 applies the first axial thrust force to the bearing 20 along the axial direction AX1, the first elastic arms 50 can also abut against an outer surface of the elastic fixing socket 12 along the axial direction AX1. As the first elastic arms 50 abut against the outer surface of the elastic fixing socket 12 along the axial direction AX1, the first elastic arm 50 can provide a first radial thrust force to the bearing 20 along a radial direction RX1 corresponding to an axle center C of the bearing holder 10 so as to force the bearing 20 to move towards the axle center C of the bearing holder 10. Similarly, when the second pressing member 40 applies the second axial thrust force to the bearing 20 along the axial direction AX2, the second pressing member 40 can also abut against the second elastic arm 60 along the axial direction AX2. As the second pressing member 40 abuts against the second elastic arm 60 along the axial direction AX2, the second elastic arm 60 can provide a second radial thrust force to the bearing 20 along the radial direction RX1 so as to force the bearing 20 to move towards the axle center C of the bearing holder 10. As a result, the bearing 20 can automatically align with the axle center C of the bearing holder 10 during assembly, so as to achieve the purpose of high-precision concentricity for the bearing holder 10 and the bearing 20.

For purposes of convenient assembly, the elastic fixing socket 12 can be designed to have an accommodation space capable of accommodating the bearing 20 without influences of any external forces. Moreover, since the elastic fixing socket 12 may not provide extra clamp force to fasten the bearing 20, a center position of the bearing 20 may deviate from the axle center C of the bearing holder 10 whiling assembling the bearing 20 on the elastic fixing socket 12. In such a situation, the first elastic arm 50 can abut against the elastic fixing socket 12 along the axial direction AX1 during assembly, so that the elastic fixing socket 12 further abuts against the bearing 20 and provides a first radial thrust force to the bearing 20. Accordingly, the bearing 20 is driven to move towards the axle center C of the bearing holder 10, so as to position the center position of the bearing 20 on the axle center C of the bearing holder 10. In other words, the bearing 20 can automatically align with the axle center C of the bearing holder 10 by using the first pressing member 30, the second pressing member 40, the first elastic arm 50 and the second elastic arm 60.

In brief, via the collaborative operations of the first pressing member 30, the second pressing member 40, the first elastic arm 50 and the second elastic arm 60, the bearing 20 can be driven to move towards the axle center C during assembling the antenna rotation mechanism 1 so as to achieve the purpose of automatically self-aligning, thereby, reducing assembly time and assembly variation.

Note that the antenna rotation mechanism 1 shown in FIG. 1 to FIG. 3 is an exemplary embodiment of the invention, and those skilled in the art can make alternations and modifications accordingly. An amount and disposition of the first elastic arm 50 and the second elastic arms 60 are dependent upon design demand. For example, the antenna rotation mechanism 1 includes a plurality of first elastic arms 50, and the plurality of first elastic arms 50 can be disposed around the bearing 20 according the shape of bearing 20. Similarly, the antenna rotation mechanism 1 includes a plurality of second elastic arms 60, and the plurality of second elastic arms 60 can be disposed around the bearing 20 according the shape of bearing 20. In addition, the elastic fixing socket 12, the first elastic arms 50 and the second elastic arms 60 can be made of flexible or deformable materials, respectively. As a result, the first elastic arms 50 and the second elastic arms 60 can be mass-produced with mould manufacturing method, instead of using a complex precision machining process.

Further description associated with the assembly of the bearing 20, the first pressing member 30, the second pressing member 40, the first elastic arm 50 and the second elastic arm 60 shown in FIG. 1 follows. First, the first pressing member 30 is installed and fixed on one plane of the bearing holder 10 while assembling. Furthermore, the bearing 20 can be disposed on the elastic fixing socket 12. In the assembly of the bearing 20, when the bearing 20 is inserted into the containing space of the elastic fixing socket 12, the bearing 20 tightly contacts with the elastic fixing socket 12, so that the elastic fixing socket 12 is pushed outwards. In such a situation, the first elastic arm 50 is stretched slightly accordingly since the elastic fixing socket 12 and the first elastic arm 50 are flexible. Thus, the bearing 20 is disposed on the elastic fixing socket 12. After that, the second pressing member 40 can be installed on another plane of the bearing holder 10 opposite to the first pressing member 30. The second elastic arms 60 can be installed around the elastic fixing socket 12. When all of the components of the antenna rotation mechanism 1 are assembled, the first pressing member 30 provides the first axial thrust force to the bearing 20 along the axial direction AX1 and the second pressing member 40 provides the second axial thrust force to the bearing 20 along the axial direction AX2. In such a situation, the bearing 20 can be axially restrained on the bearing holder 10. Furthermore, when the first pressing member 30 provides the first axial thrust force to the bearing 20 along the axial direction AX1, the first pressing member 30 can also abut against the first elastic arm 50 along the axial direction AX1, so that the first elastic arm 50 further abuts against the elastic fixing socket 12 and provides a first radial thrust force to the bearing 20 along the radial direction RX1. Therefore, the bearing 20 can be forced to move towards the axle center C of the bearing holder 10. Similarly, when the second pressing member 40 provides the second axial thrust force to the bearing 20 along the axial direction AX2, the second pressing member 40 can also abut against the second elastic arm 60 along the axial direction AX2, so that the second elastic arm 60 further abuts against the elastic fixing socket 12 and provides a second radial thrust force to the bearing 20 along the radial direction RX1. Therefore, the bearing 20 can be forced to move towards the axle center C of the bearing holder 10. Thereby, the bearing 20 can automatically align with the axle center C of the bearing holder 10 during assembly, so as to achieve the purpose of high-precision concentricity for the bearing holder 10 and the bearing 20. As a result, via the above simple operations, components of the antenna rotation mechanism 1 can be rapidly and accurately assembled.

Figure 4:
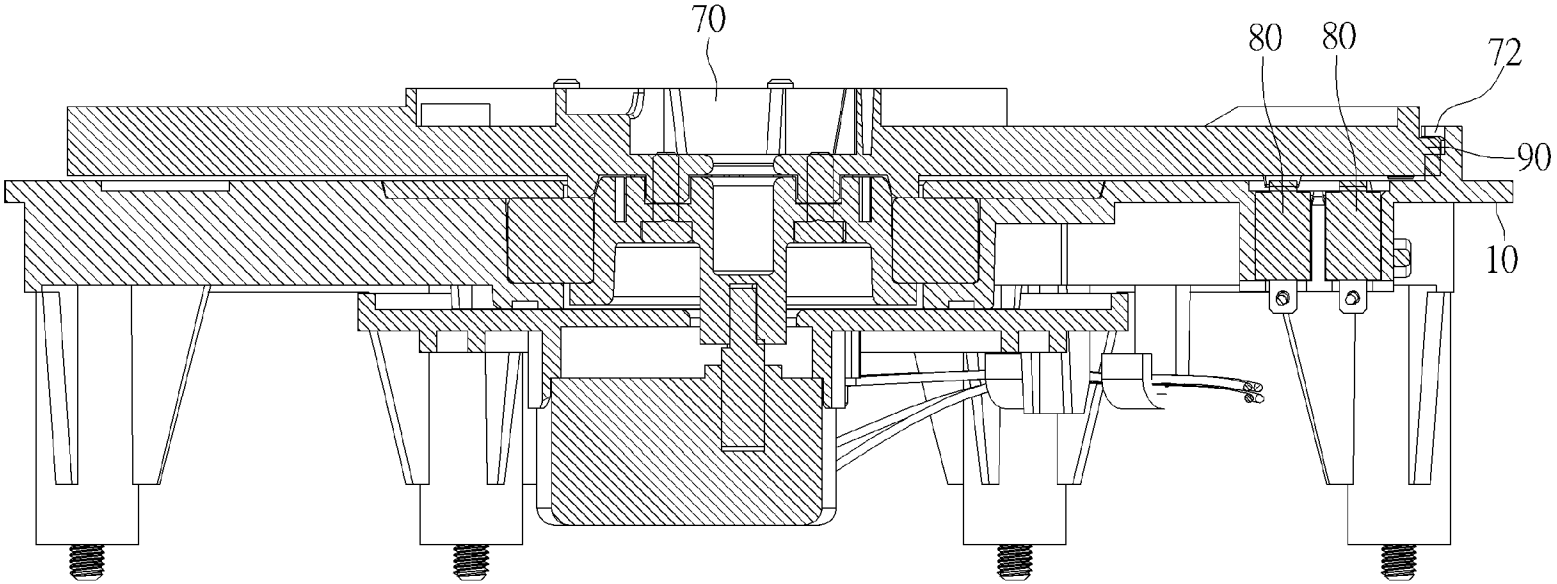
FIG. 4 and FIG. 5 respectively are schematic diagrams illustrating a position detecting module of the antenna rotation mechanism according to embodiments of the present invention.
Figure 5:
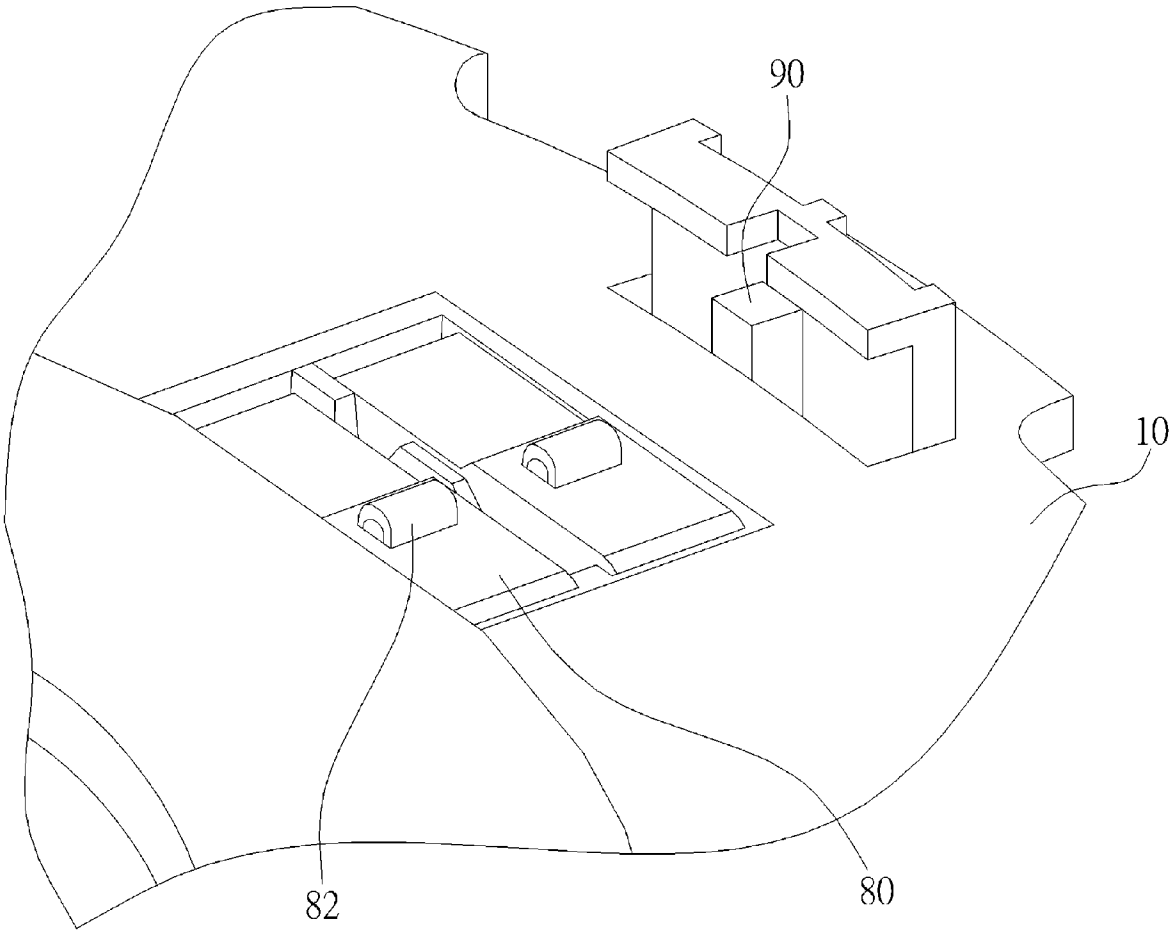

On the other hand, please refer to FIG. 4 and FIG. 5. FIG. 4 and FIG. 5 are schematic diagrams illustrating a position detecting module 80 of the antenna rotation mechanism 1 according to embodiments of the present invention. As shown in FIG. 4 and FIG. 5, the antenna rotation mechanism 1 further includes a position detecting module 80. The position detecting module 80 is disposed on the bearing holder 10 for detecting a rotation position of the antenna and generating a position sensing signal to a host accordingly. As a result, the host can identify the current position of the antenna mounted on the rotation bracket 70 according to the received position sensing signal for the following rotation angle calculation and operation control. In addition, the rotation bracket 70 includes a position triggering member (not shown in figures). When the position triggering member of the rotation bracket 70 rotates to the position of the position detecting module 80, the position triggering member contacts the position detecting module 80. As such, the position detecting module 80 will generate a corresponding position sensing signal to the host after the position triggering member contacts the position detecting module 80. For example, the position detecting module 80 includes a switch 82. When the position triggering member rotates to contact the switch 82, the switch 82 can be triggered to generate a corresponding position sensing signal to the host. This means, the antenna is rotated to a predetermined position. In other words, the position detecting module 80 can response the current position of the antenna for improving accurate rotation control.

Figure 6:
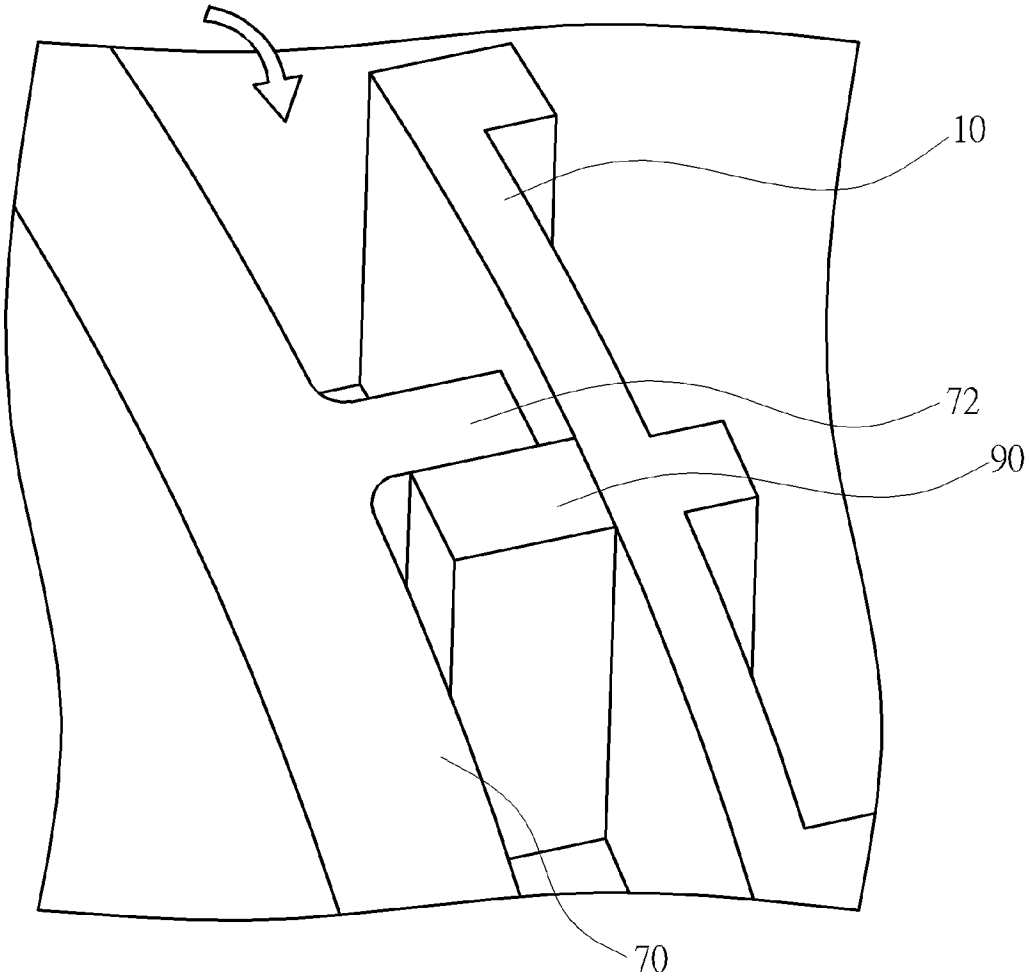
FIG. 6 is a schematic diagram illustrating a stopper of the antenna rotation mechanism according to embodiments of the present invention.

Please refer to FIG. 5 and FIG. 6. FIG. 6 is a schematic diagram illustrating a stopper 90 of the antenna rotation mechanism 1 according to embodiments of the present invention. As shown in FIG. 5 and FIG. 6, the antenna rotation mechanism 1 further includes a stopper 90. The stopper 90 is disposed on the bearing holder 10. The rotation bracket 70 further includes a limiting member 72. When the limiting member 72 of the rotation bracket 70 is rotated to contact the stopper 90, the stopper 90 abuts the limiting member 72 to constrain the further rotation of the rotation bracket 70. That is, the stopper 90 stops the limiting member 72 as to limit a rotating range of the rotation bracket 70 relative to the bearing holder 10. In other words, through the design of the stopper 90 with the limiting member 72, the invention can constrain a rotation angle range of the rotation bracket 70 to prevent the rotation bracket 70 from over-rotating caused by motor runaway or control system failure.

Figure 7:
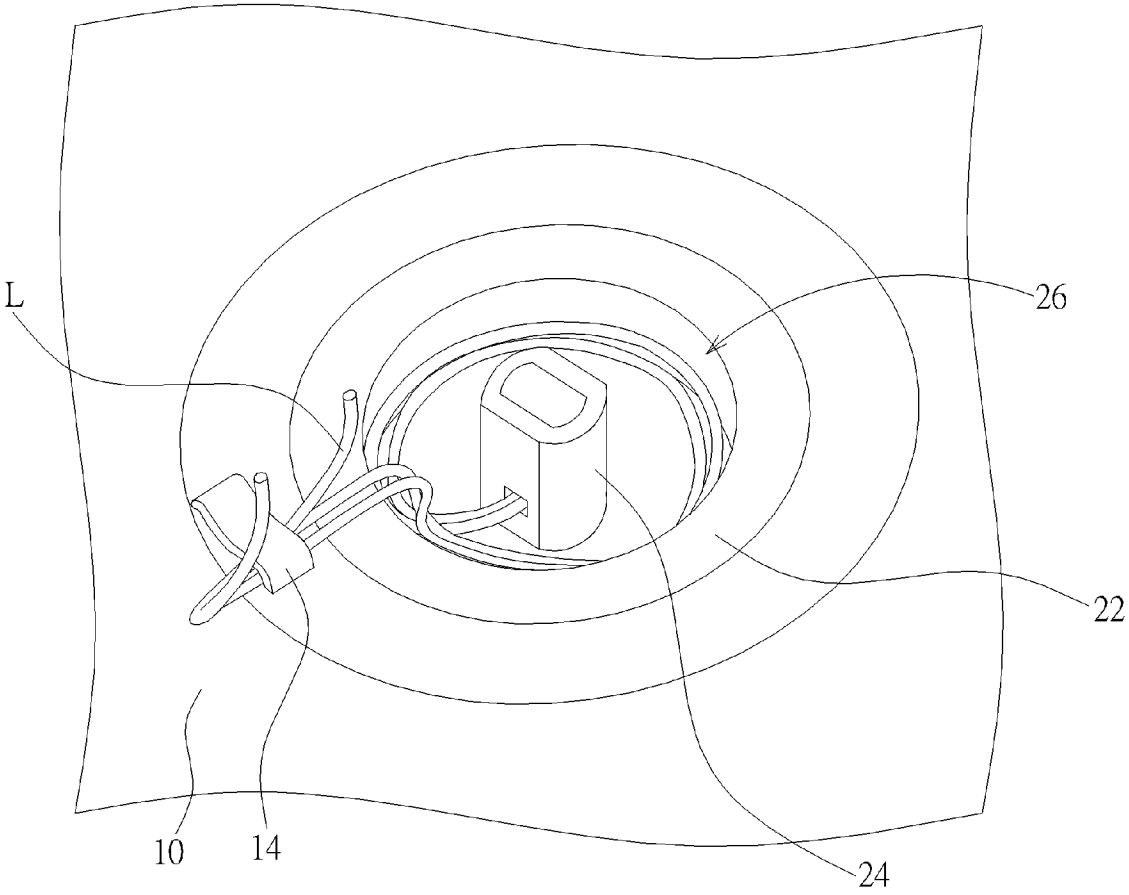
FIG. 7 to FIG. 9 respectively are schematic diagrams illustrating a portion of the automatic cable winding scheme for the antenna rotation mechanism according to embodiments of the present invention.
Figure 8:
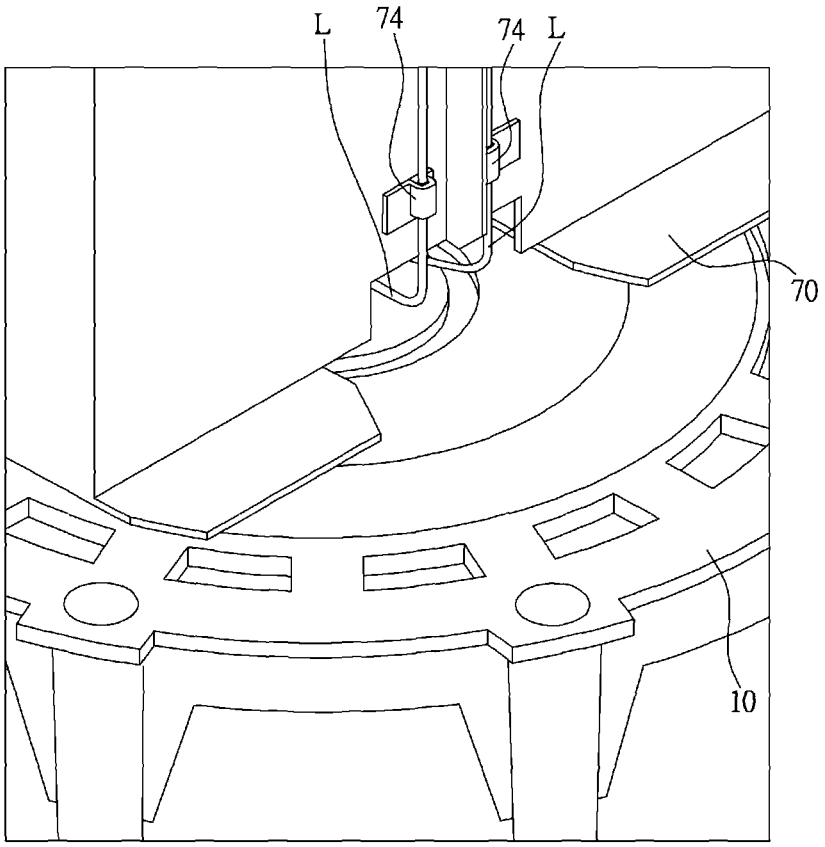
Figure 9:
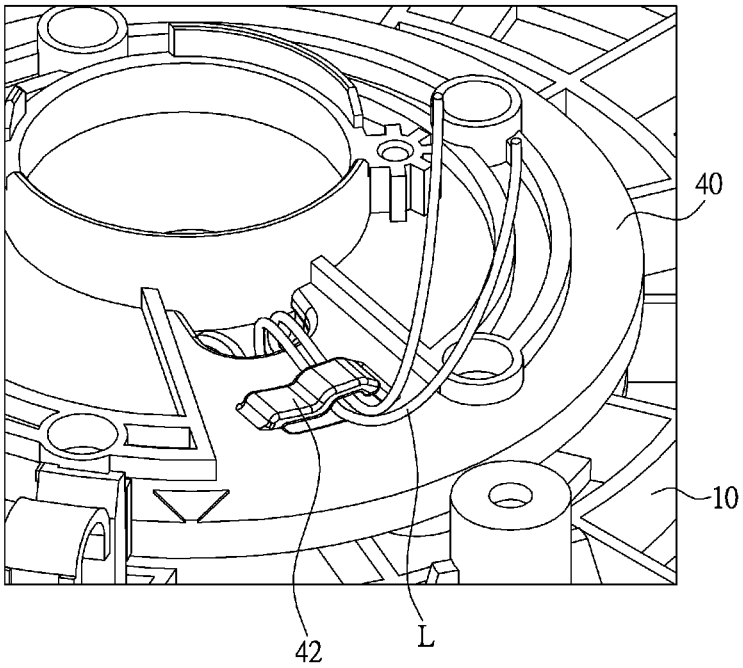

In addition, when the antenna is driven to rotate, a transmission cable mounted on the antenna for transmitting signals may break quite often due to staggered winding and uneven winding. Therefore, the invention further provides an automatic cable winding scheme for solving the above-mentioned problem. Please refer to FIG. 7 to FIG. 9, FIG. 7 to FIG. 9 are schematic diagrams illustrating a portion of the automatic cable winding scheme for the antenna rotation mechanism 1 according to embodiments of the present invention. As shown in FIG. 7, the bearing holder 10 further includes a cable fixing member 14. The cable fixing member 14 is utilized for fixing a first end of a transmission cable L. As shown in FIG. 8, the rotation bracket 70 further includes a cable fixing member 74. The cable fixing member 74 is utilized for fixing a second end of the transmission cable L on the rotation bracket 70. Please further refer to FIG. 7, the bearing 20 further includes a cable accommodation portion 22 and a winding shaft 24. The cable accommodation portion 22 includes an accommodation space 26. The accommodation space 26 is formed in the able accommodation portion 22 for accommodating the transmission cable L. The rotatable shaft P shown in FIG. 1 can pass through the winding shaft 24 and be disposed within the winding shaft 24. When the rotatable shaft P and the rotation bracket 70 are driven to rotate by a driving source, e.g. a motor, the cable segment of the transmission cable L between the cable fixing member 74 and the cable fixing member 14 winds around the winding shaft 24, so that the transmission cable L is collected into the accommodation space 26. In other words, since one end of the transmission cable L is fixed on the bearing holder 10 and the other end of the transmission cable L is fixed on the rotation bracket 70, the transmission cable L can be winded around or unwinded from the winding shaft 24 during rotation of the antenna, so that the transmission cable L can be arranged into the accommodation space 26 automatically and orderly.

In an alternative embodiment of the invention, please refer to FIG. 9. Since the second pressing member 40 is fixed on the bearing holder 10 after assembly, the cable fixing member can also be disposed on the second pressing member 40. For example, as shown in FIG. 9, the second pressing member 40 further includes a cable fixing member 42 for fixing a first end of a transmission cable L. The cable fixing member 74 shown in FIG. 8 is utilized for fixing a second end of the transmission cable L on the rotation bracket 70. Similarly, when the rotatable shaft P and the rotation bracket 70 are driven to rotate, the cable segment of the transmission cable L between the cable fixing member 74 and the cable fixing member 42 winds around the winding shaft 24. Thus, the transmission cable L is collected into the accommodation space 26.

Figure 10:
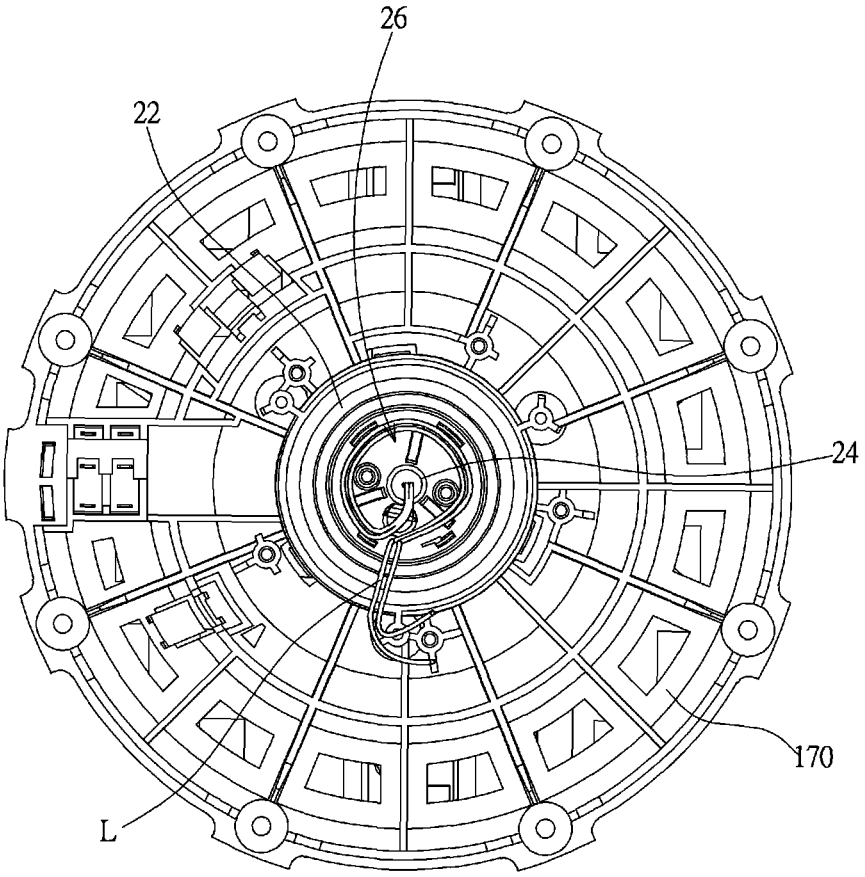
FIG. 10 and FIG. 11 respectively are schematic diagrams illustrating the automatic cable winding scheme for the antenna rotation mechanism before rotation according to embodiments of the present invention.
Figure 11:
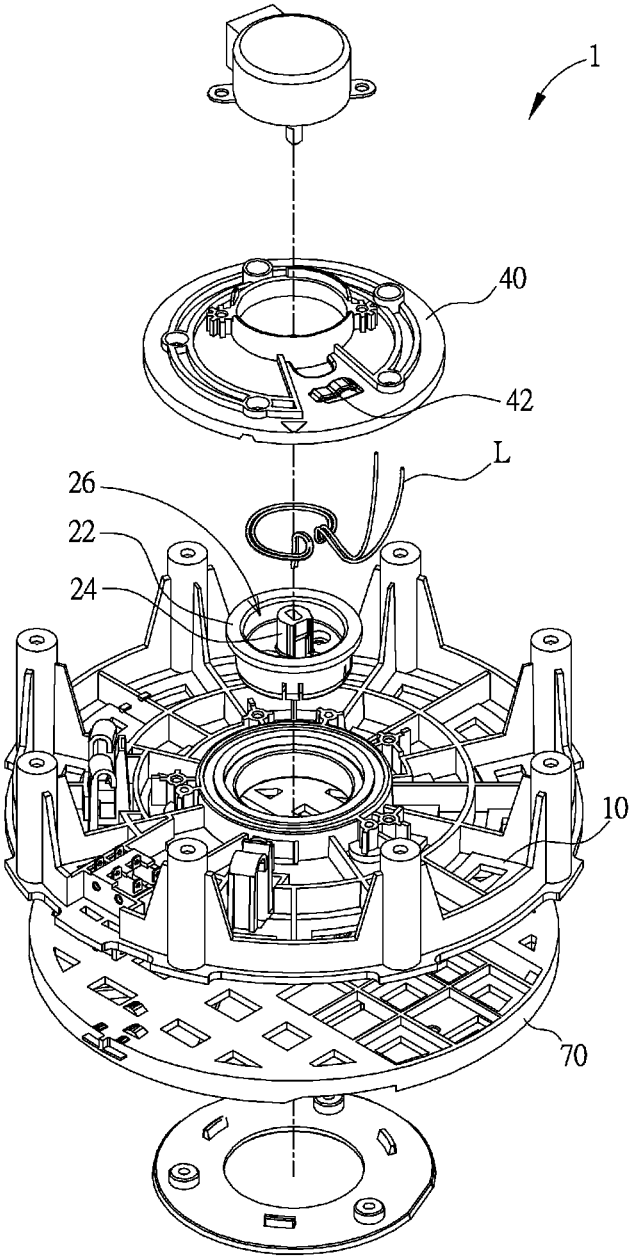
Figure 12:
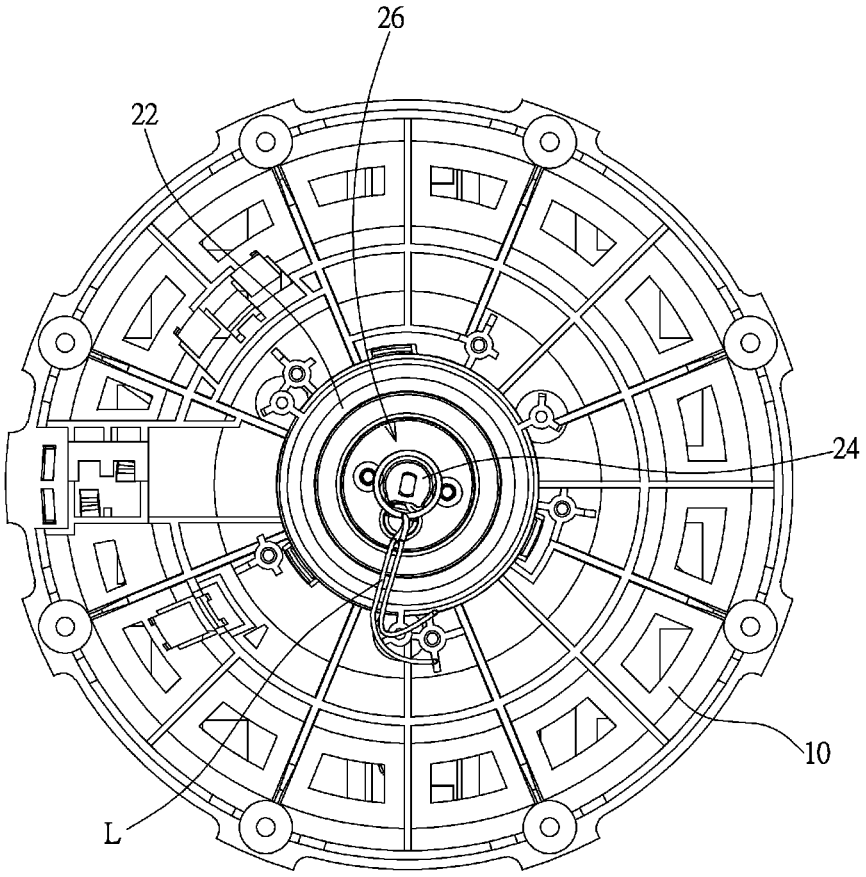
FIG. 12 and FIG. 13 respectively are schematic diagrams illustrating the automatic cable winding scheme for the antenna rotation mechanism after rotation according to embodiments of the present invention.
Figure 13:
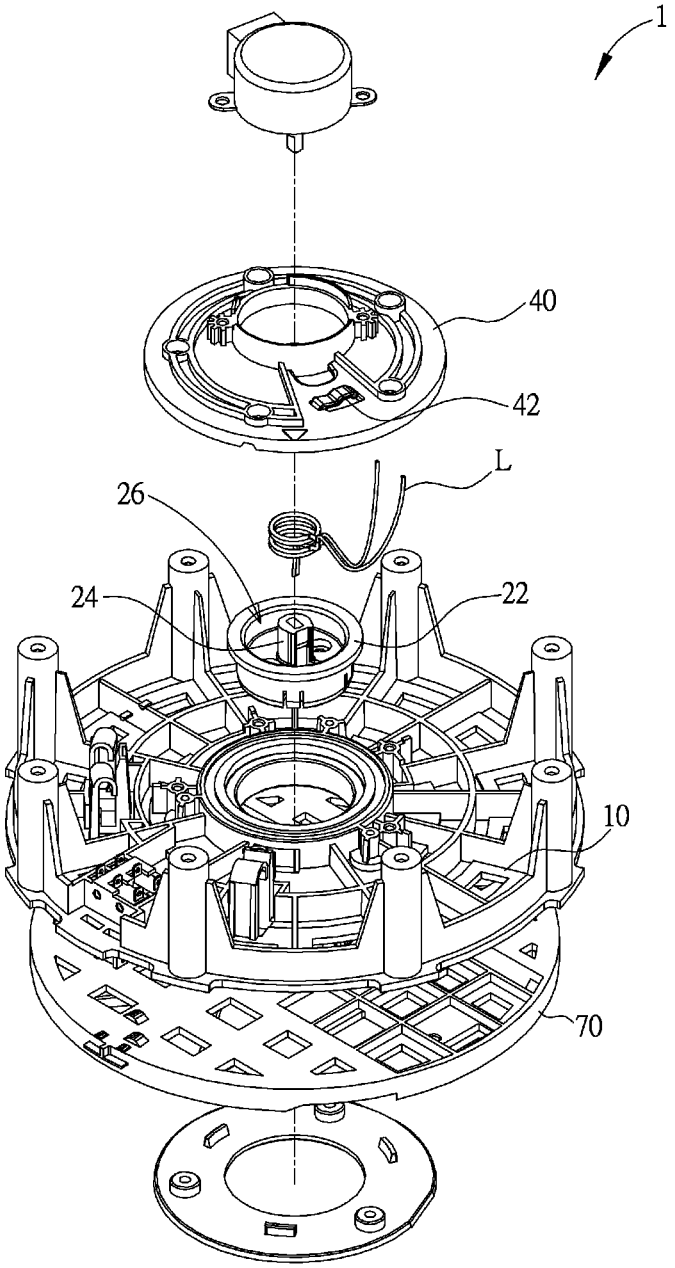

Moreover, please refer to FIG. 10 to FIG. 13. FIG. 10 and FIG. 11 are schematic diagrams illustrating the automatic cable winding scheme for the antenna rotation mechanism 1 before rotation according to embodiments of the present invention. FIG. 12 and FIG. 13 are schematic diagrams illustrating the automatic cable winding scheme for the antenna rotation mechanism 1 after rotation according to embodiments of the present invention. The rotation bracket 70 includes a cable fixing member (not shown in figures). The second pressing member 40 includes a cable fixing member 42. As shown in FIG. 10 and FIG. 11, before the antenna rotates, the transmission cable L is wound in a larger circle-shaped manner and collected in the accommodation space 26. As shown in FIG. 12 and FIG. 13, the antenna has rotated a certain angle, i.e. the rotation bracket 70 rotates a certain angle, the transmission cable L is wounds around the winding shaft 24 orderly and evenly and collected into the accommodation space 26. In other words, during rotation of the antenna, the transmission cable L can be arranged into the accommodation space 26 instead of exposing outside, so as to avoid the problem of staggered winding, uneven winding and interference with other components.

In summary, via the collaborative operations of the pressing members and elastic arms, the bearing of the invention can automatically align with the axle center of the bearing holder during assembling, so as to achieve the purpose of high-precision concentricity, and thus, reducing assembly time and assembly variation. On the other hand, the position detecting module of the invention can response the current position of the antenna for improving accurate rotation control. Moreover, through the design of the stopper with the limiting member, the invention can constrain a rotation angle range of the rotation bracket to prevent the rotation bracket from over-rotating. In addition, the automatic cable winding scheme for the antenna rotation mechanism can arrange transmission cable into the accommodation space during rotation, so as to avoid the problem of staggered winding, uneven winding and interference with other components.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An antenna rotation mechanism, comprising:

a bearing holder;

a bearing, disposed on an elastic fixing socket of the bearing holder;

a first pressing member, disposed on a first plane of the bearing;

a second pressing member, disposed on a second plane of the bearing;

a plurality of first elastic arms, connected to the first pressing member, each of the first elastic arms being connected to the first pressing member, wherein when the plurality of first elastic arms abut against an outer surface of the elastic fixing socket, the each of the first elastic arms provides a first radial thrust force to the bearing, such that the bearing moves towards an axle center; and a plurality of second elastic arms, connected to the second pressing member, each of the second elastic arms being connected to the second pressing member, wherein when the second pressing member abuts against the outer surface of the elastic fixing socket, the each of the second elastic arms provides a second radial thrust force to the bearing, such that the bearing moves towards the axle center.

2. The antenna rotation mechanism of claim 1, wherein the first pressing member provides the first radial thrust force and the second pressing member provides the second radial thrust force to the bearing, such that the bearing is axially restrained on the bearing holder during assembly.

3. The antenna rotation mechanism of claim 1, further comprising:

a rotation bracket and a first cable fixing member for fixing a first end of a transmission cable on the rotation bracket, wherein the bearing further comprises a cable accommodation portion and a winding shaft, wherein the cable accommodation portion comprises an accommodation space.

4. The antenna rotation mechanism of claim 3, further comprising:

a position detecting module, disposed on the bearing holder, for detecting a rotation position of the antenna and accordingly generating a position sensing signal to a host.

5. The antenna rotation mechanism of claim 4, wherein the position detecting module comprises a switch, when a position trigger member of the rotation bracket contacts the switch, the switch generates the position sensing signal to the host.

6. The antenna rotation mechanism of claim 3, further comprising:

a stopper, disposed on the bearing holder, wherein when a limiting member of the rotation bracket is rotated to contact the stopper, the stopper abuts the limiting member to limit a rotating range of the rotation bracket relative to the bearing holder.

7. The antenna rotation mechanism of claim 3, wherein the bearing holder further comprises a second cable fixing member for fixing a second end of the transmission cable, when the rotation bracket rotates, a cable segment of the transmission cable between the first end and the second end winds around the winding shaft so as to collect into the accommodation of the space cable accommodation portion.

* * * * *